US009844285B2

(12) United States Patent
Hoskins

(10) Patent No.: US 9,844,285 B2
(45) Date of Patent: Dec. 19, 2017

(54) BOTTLE CAPS WITH MULTI-POSITION VALVES

(71) Applicant: Matt Hoskins, Bend, OR (US)

(72) Inventor: Matt Hoskins, Bend, OR (US)

(73) Assignee: TSI Manufacturing, LLC, Bend, OR (US)

( * ) Notice: Subject to any disclaimer, the term of this patent is extended or adjusted under 35 U.S.C. 154(b) by 23 days.

(21) Appl. No.: 14/956,195

(22) Filed: Dec. 1, 2015

(65) Prior Publication Data

US 2016/0150898 A1 Jun. 2, 2016

Related U.S. Application Data

(60) Provisional application No. 62/086,014, filed on Dec. 1, 2014.

(51) Int. Cl.

| | |
|---|---|
| ***B65D 51/16*** | (2006.01) |
| ***A47G 19/22*** | (2006.01) |
| ***B65D 47/20*** | (2006.01) |

(52) U.S. Cl.

CPC ..... *A47G 19/2266* (2013.01); *B65D 47/2018* (2013.01); *B65D 47/2037* (2013.01)

(58) Field of Classification Search

CPC ..... B65D 47/065; B65D 43/02; B65D 43/26; B65D 43/22; B65D 43/16; B65D 47/2037; B65D 47/2018; A47G 19/2266

USPC ... 220/254.1, 254.3, 259.1, 703, 705, 254.4, 220/254.6, 818, 707, 708, 709, 711, 212; 215/229, 387, 388

See application file for complete search history.

(56) References Cited

U.S. PATENT DOCUMENTS

| | | | |
|---|---|---|---|
| 2,755,974 | A | 7/1956 | Godfrey |
| 2,797,837 | A | 7/1957 | Roberts |
| 3,128,000 | A | 4/1964 | Haberle |
| 4,531,655 | A | 7/1985 | Putnam |
| 4,775,081 | A | 10/1988 | Morane |
| 4,830,227 | A | 5/1989 | Ball et al. |
| 5,297,686 | A | 3/1994 | Takeuchi |
| 5,505,345 | A | 4/1996 | Zeid |
| 6,039,305 | A | 3/2000 | Hoskins et al. |

(Continued)

FOREIGN PATENT DOCUMENTS

| | | |
|---|---|---|
| CH | 276694 | 11/1951 |
| DE | 1141555 | 12/1962 |

(Continued)

*Primary Examiner* — Kareen Thomas

(74) *Attorney, Agent, or Firm* — Klarquist Sparkman, LLP

(57) ABSTRACT

Disclosed are embodiments of bottle caps that comprise a rigid body configured to be secured to an opening of a bottle, a multi-position valve coupled to the body for regulating fluid flow through the cap, and a lid coupled to the body that can cover the valve. The cap can be adjustable between at least a closed position, a selectively open position, and a fully open position. In the closed position, the lid covers the multi-position valve and fluid flow through the multi-position valve is prevented. In the selectively open position, the lid is uncovered from the multi-position valve and the multi-position valve is operable to open to allow fluid flow when a flexible portion of the multi-position valve is squeezed by a user. In the fully open position, the lid is uncovered from the multi-position valve and fluid can flow freely through the multi-position valve.

17 Claims, 14 Drawing Sheets

(56) References Cited

U.S. PATENT DOCUMENTS

| | | | | |
|---|---|---|---|---|
| 6,199,729 | B1 | 3/2001 | Drzymkowski | |
| 6,276,560 | B1 | 8/2001 | Belcastro | |
| 6,523,711 | B1 * | 2/2003 | Hughes | A47G 19/2266 215/308 |
| 6,994,269 | B2 | 2/2006 | Lien | |
| 7,097,078 | B2 | 8/2006 | Sanchez | |
| 7,341,097 | B2 | 3/2008 | Darby | |
| 7,464,837 | B2 | 12/2008 | Hoskins | |
| 7,533,783 | B2 | 5/2009 | Choi et al. | |
| 7,621,294 | B2 | 11/2009 | Wang | |
| 7,648,038 | B2 | 1/2010 | Brozell | |
| 7,806,300 | B1 | 10/2010 | Noell | |
| 7,931,175 | B2 | 4/2011 | Hjort | |
| 8,152,138 | B2 | 4/2012 | Skillern | |
| 8,336,724 | B2 | 12/2012 | Yamashita et al. | |
| 8,376,173 | B2 | 2/2013 | Britto et al. | |
| 8,602,238 | B2 | 12/2013 | El-Saden et al. | |
| 8,622,237 | B2 * | 1/2014 | Choi | A47G 19/2266 215/11.4 |
| 8,646,658 | B2 | 2/2014 | Bae | |
| 8,978,923 | B2 * | 3/2015 | George | 215/311 |
| 9,079,205 | B2 | 7/2015 | Hoskins | |
| 2010/0307715 | A1 | 12/2010 | Emenheiser | |
| 2012/0181277 | A1 * | 7/2012 | Wang-Wu | B65D 47/305 220/212 |
| 2012/0234789 | A1 * | 9/2012 | Mason | B65D 77/28 215/229 |
| 2012/0273074 | A1 | 11/2012 | Yamada et al. | |
| 2012/0305559 | A1 * | 12/2012 | Steininger | B65D 47/065 220/253 |
| 2013/0175302 | A1 | 7/2013 | Sariu | |
| 2015/0122358 | A1 | 5/2015 | Hoskins | |
| 2015/0173539 | A1 * | 6/2015 | Mason | A47G 19/2272 220/707 |
| 2015/0196148 | A1 | 7/2015 | Hoskins | |

FOREIGN PATENT DOCUMENTS

| | | |
|---|---|---|
| GB | 387446 | 2/1933 |
| JP | 3524649 | 3/1997 |

* cited by examiner

BOTTLE CAPS WITH MULTI-POSITION VALVES

CROSS-REFERENCE TO RELATED APPLICATIONS

This application claims the benefit of U.S. Provisional Patent Application No. 62/086,014 filed Dec. 1, 2014, which is incorporated by reference herein in its entirety.

FIELD

This application is related to bottle caps having multi-position valves for controlling fluid flow.

BACKGROUND

Conventional bottle caps have to be removed from a bottle to access the fluid in the bottle. Some bottle caps include straw or a valved conduit passing through the bottle cap so that fluid can be consumed without removing the cap from the bottle. Some bottle caps with a valved conduit can be adjusted to close the conduit so that liquid does not escape from the bottle when it is not in use.

SUMMARY

Disclosed herein are embodiments of bottle caps with multi-position valves for regulating fluid flow from a bottle or other fluid container. Exemplary bottle caps can comprise a rigid body configured to be secured to an opening of a bottle, a multi-position valve coupled to the body for regulating fluid flow through the cap, and a lid coupled to the body that can cover the valve. The cap can be adjustable between at least a closed position, a selectively open position, and a fully open position. In the closed position, the lid covers the multi-position valve and fluid flow through the multi-position valve is prevented. In the selectively open position, the lid is uncovered from the multi-position valve and the multi-position valve is operable to open to allow fluid flow when a flexible portion of the multi-position valve is squeezed by a user and the multi-position valve is configured to remain closed to block fluid flow when the flexible portion is not engaged by a user. In the fully open position, the lid is uncovered from the multi-position valve and fluid can flow freely through the multi-position valve.

In the selectively open position, the multi-position valve can operable as a bite valve such that a user can selectively open the multi-position valve to allow fluid flow by biting on a flexible sheath portion of the multi-position valve.

In some embodiments, the multi-position valve comprises a flexible tube portion that is collapsed to prevent fluid flow in the closed position, and open to allow fluid flow in the selectively open position and the fully open position. The mechanism for collapsing the tube portion can vary in different embodiments. In some embodiments, the multi-position valve is pivotally coupled to the body of the cap and the multi-position valve is pivotable between folded down position when the cap is in the closed position and an unfolded position when the cap is in the selectively open position or the fully open position. In such embodiments, when the multi-position valve is in the folded down position, the flexible tube of the multi-position valve is bent, which cause the tube to collapsed and prevents fluid flow through the multi-position valve. In addition, in some embodiments, the flexible tube of the multi-position valve is also pinched between a first surface on the multi-position valve and a second surface on the body of the cap in the closed position.

In some embodiments, the multi-position valve comprises a rigid valve base having a fluid passage therethrough, a rigid annular collar adjustably mounted around an outer surface of the valve base, a flexible sheath mounted on the collar, and a rigid stem mounted to the valve base. The collar and the sheath can be axially adjustable relative to the valve base and stem to adjust the cap between the selectively open position and the fully open position. In the selectively open position, a head of the stem can seal against an inner surface of the sheath to block fluid flow from the fluid passage of the valve base through the sheath when the sheath is not engaged by a user, and an opening is formed between the head of the stem and the inner surface of the sheath when the sheath is squeezed (e.g., bitten) by a user. The stem can include a narrow neck portion between the head of the stem and the valve base, such that the opening is formed between the head of the stem and the inner surface of the sheath when the sheath is squeezed by the user around the neck portion of the stem. In the fully open position, the head of the stem is positioned within a portion of the sheath having an inner diameter that is greater that a diameter of the head of stem, such that fluid is allowed to flow freely through the sheath around the head of the stem.

In some embodiments, the cap further includes a slider that is horizontally slidable relative the body between a first position wherein the slider impinges on a vertical flexible tube of the multi-position valve to prevent fluid flow therethrough and a second position wherein the slider does not impinge the flexible tube such that fluid can flow through the tube. The motion of the lid relative to the body can control the motion of the slider between the first and second positions. The lid can be pivotable relative to the body about a pivot axis between a closed position and an open position, wherein the pivotal position of the lid corresponds to the sliding position of the slider. The closed position of the lid can corresponds to the first position of the slider and an open position of the lid can corresponds to the second position of the slider. The lid can include a rounded surface that extends circumferentially around the pivot axis, such that the rounded surface varies in radial distance from the pivot axis as a function of circumferential position about the pivot axis. The slider can include a contact surface that engages with the rounded surface of the lid such that the position of the slider relative to the body is controlled by the radial distance from the pivot axis of the portion of the rounded surface that is in contact with the contact surface of the slider. In such embodiments, pivoting the lid from the open position toward the closed position causes the rounded surface of the lid to push the slider further from the pivot axis and further into the tube, and opening the lid releases the slider from the tube and allows fluid to flow through the tube.

The foregoing and other objects, features, and advantages of the disclosed technology will become more apparent from the following detailed description, which proceeds with reference to the accompanying figures.

DETAILED DESCRIPTION

Disclosed herein are exemplary embodiments of bottle caps having multi-position valves. Disclosed valves allow for manual actuation of the cap and valve between three or more positions, including a closed position, a selectively open position where a user can obtain fluid through the valve by selectively actuating a bite valve, and a fully open position where the bite valve is disengaged to permit free flow of fluid through the valve.

Figure 1:
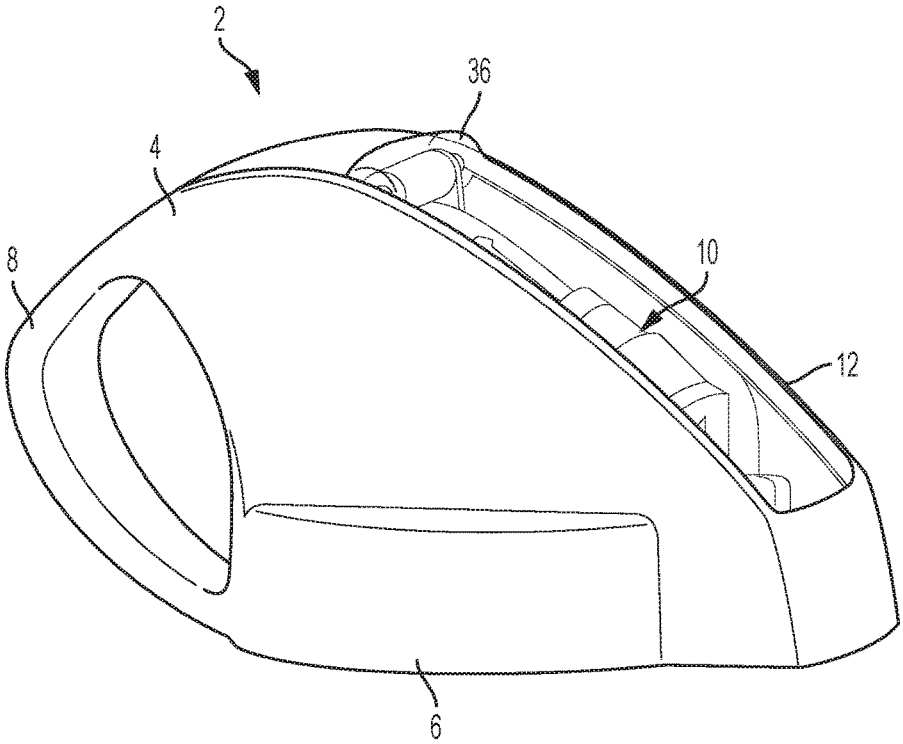
FIG. 1 is a side view of an exemplary bottle cap having a multi-position valve, shown in a closed position.
Figure 2:
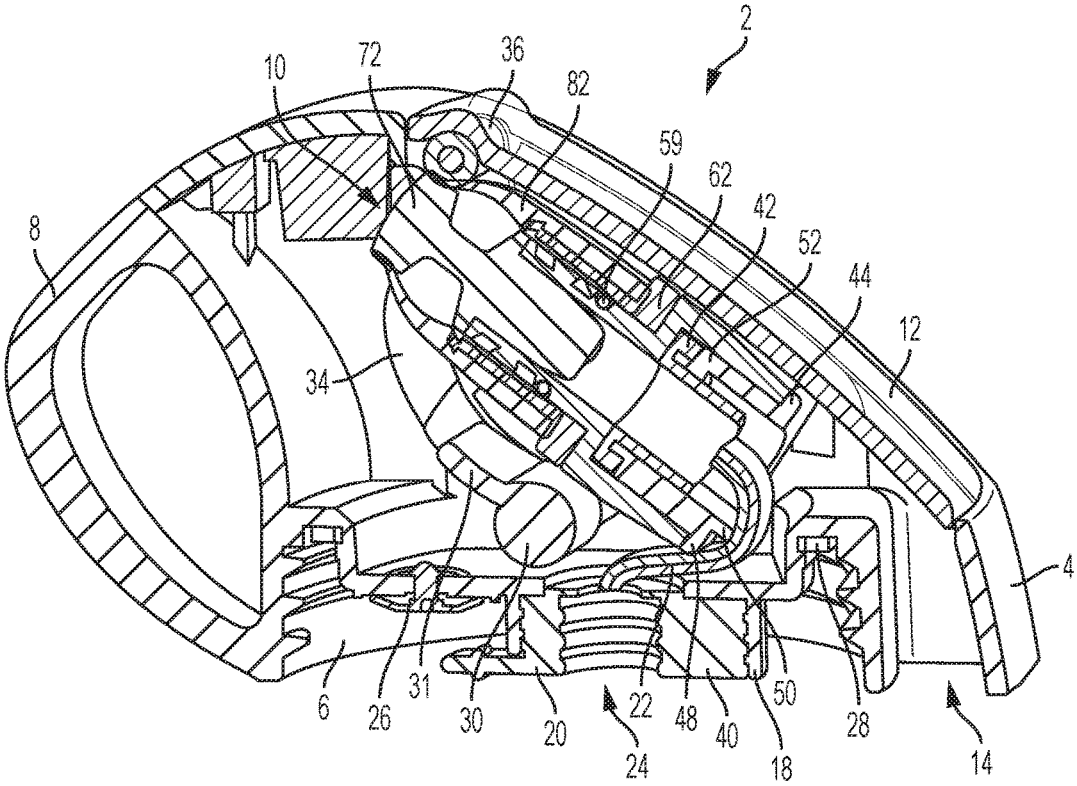
FIG. 2 is a cross-sectional view of the bottle cap of FIG. 1 in the closed position.
Figure 3:
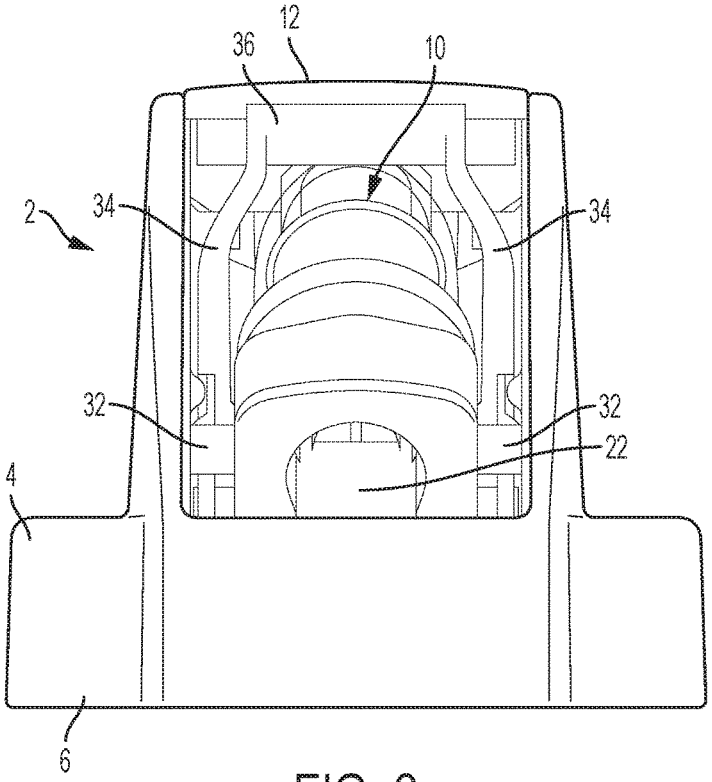
FIG. 3 is a front view of the bottle cap of FIG. 1 in the closed position.
Figure 4:
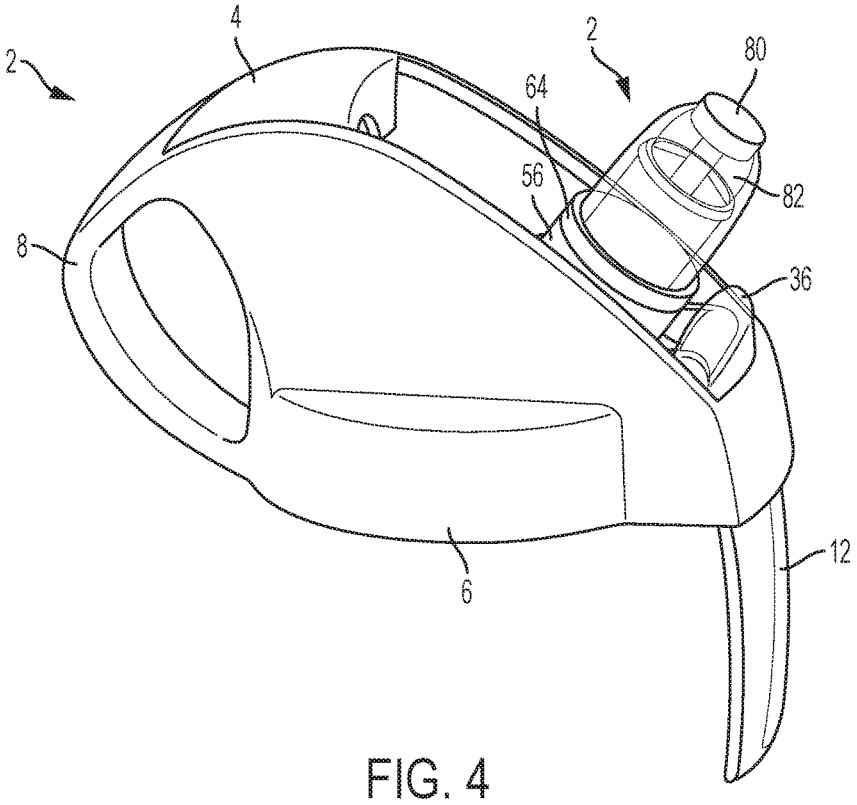
FIG. 4 is a perspective view of the bottle cap of FIG. 1 in a selectively open position wherein the valve can function as a bite valve to dispense fluid.
Figure 5:
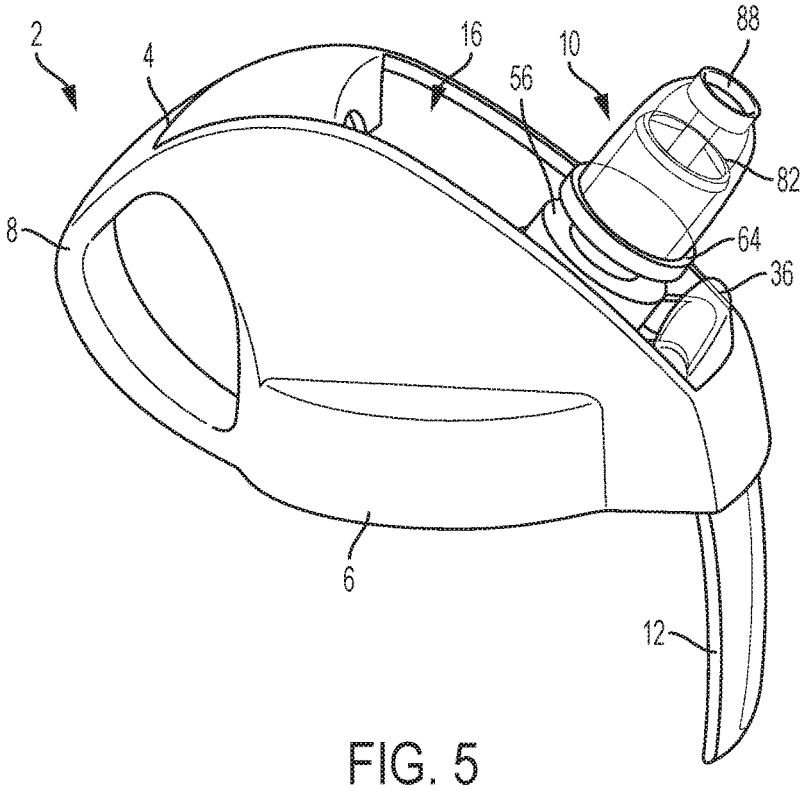
FIG. 5 is a perspective view of the bottle cap of FIG. 1 in a fully open position wherein the fluid can freely flow through the valve.
Figure 6:
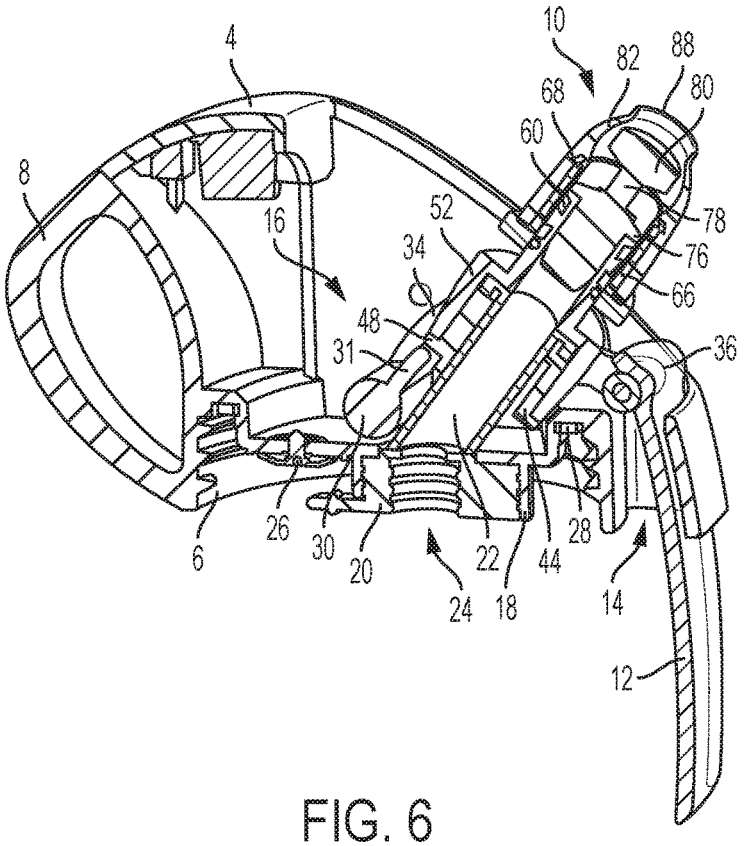
FIG. 6 is a cross-sectional view of the bottle cap of FIG. 5 in the fully open position.
Figure 7:
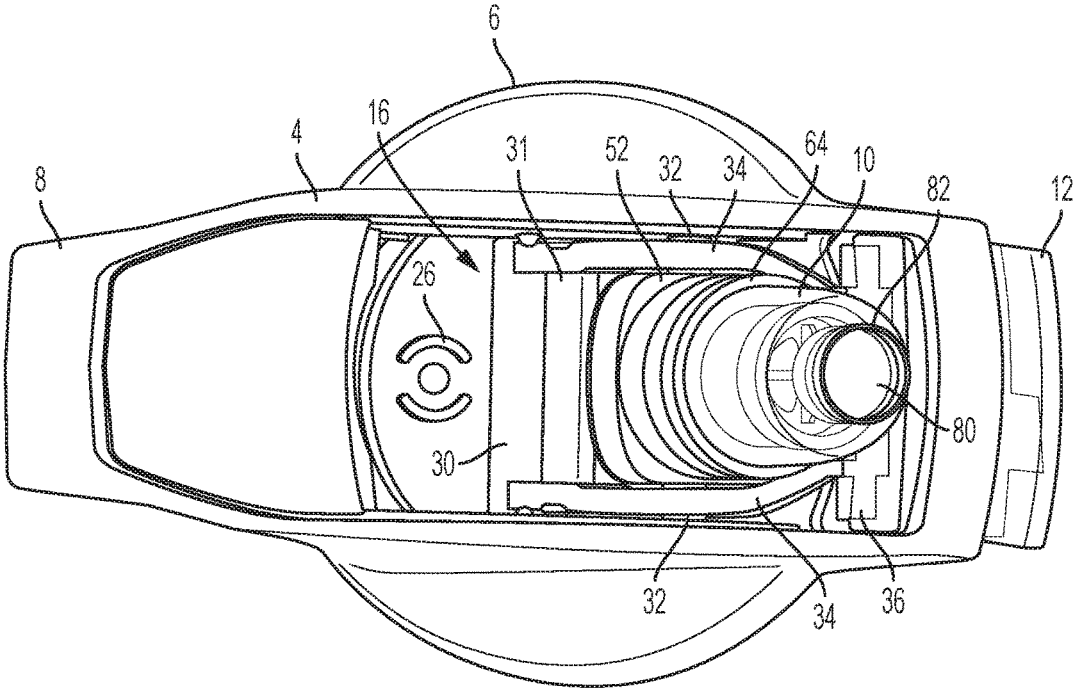
FIG. 7 is a top view of the bottle cap of FIG. 5 in the fully open position.

FIGS. 1-5 show an exemplary bottle cap 2 with a multi-position valve in various operative positions. FIGS. 1-3 show the cap 2 with valve 10 in a closed position, FIG. 4 shows the valve in a selectively open position, and FIGS. 5-7 show the valve in a fully open position.

Figure 8:
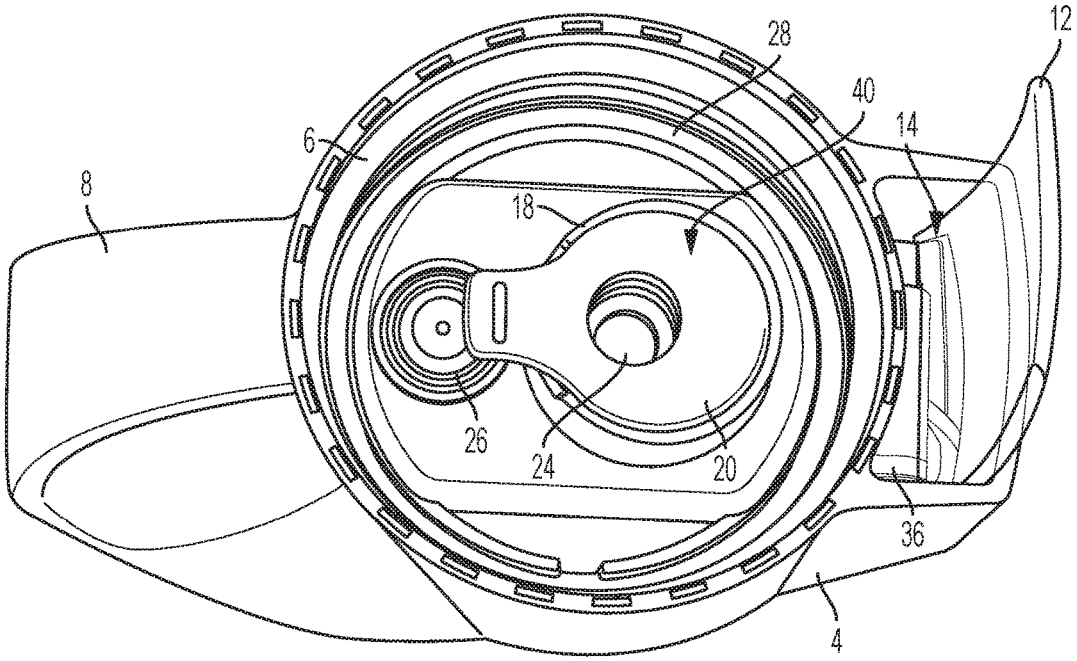
FIG. 8 is a bottle view of the bottle cap of FIG. 1 in an open configuration.

The cap 2 comprises a rigid body 4 having a threaded lower opening 6 for attaching to an upper opening of a bottle, an optional handle 8, an adjustable valve 10, and a lid 12. As shown in FIG. 2, the cap 2 further includes a flexible, collapsible tube 22 that extends from the base of the valve 10 to a lower fluid inlet 24 adapted to be coupled to a filter and/or a straw that extends down into a bottle to access fluid therein. The lower end of the tube 22 includes a seal 20 that seats within an annular collar 18 of the body, as is illustrated in the bottom view of FIG. 8. The cap 2 can also include an air vent and umbrella valve 26 in the body 4 that allows air to enter a bottle through the cap but prevents fluid from escaping. The cap 2 can also include a gasket 28 above the threaded opening 6 to help seal the cap to a bottle to prevent leaks.

In the closed position of FIGS. 1-3, the valve 10 is tucked into a cavity 16 in the body 4 and the lid 12 is closed. As shown in FIG. 2, the tube 22 collapses in the closed position such that fluid flow through the tube is blocked. For example, the tube 22 can be pinched between a surface of the valve 10 and a surface of the body 4 to collapse the tube. In the closed position, the lid 12 covers the cavity 16 and the valve 10.

To move from the closed position to the selectively open position shown in FIG. 4, the lid 12 can be moved downwardly and forwardly through an opening 14 in the body 4 of the cap to the position shown in FIG. 4. The lid 12 can include a hinge 36 at its upper rear end that is pivotably coupled to two arms 34 within the cavity on opposite sides of the valve 10 (see FIGS. 3 and 7). The lower, opposite ends of the arms 34 can be pivotably coupled to a pivot joint 30 (see FIGS. 2, 6, and 7) that is engaged with the body 4 on either side of the cavity 16. Moving the lid 12 forwardly and downwardly from the closed position causes the hinge 36 at the top rear of the lid to pivot with the arms 34 about the axis of the pivot joint 30 to the position shown in FIG. 7.

This pivoting motion of the arms 34 and pivot joint 30 also causes a flange 31 coupled to the pivot joint 30 (see FIGS. 2, 6, and 7), to push the valve 10, causing the valve to pivot upwardly and forwardly out of the cavity 16 to the position shown in FIG. 4. The valve 10 can pivot relative to the body 4 about pivots 32 (see FIGS. 3 and 7) on either side of the valve 10. Thus, the opening motion of the lid 12 is tied directly to the pivoting motion of the valve 10. To move back to the closed position of FIGS. 1-3, the hinge 36 of the lid 12 contacts the front side of the valve 10 and pushes the valve, causing the valve 10 to pivot about the pivots 32 back to the tucked down position shown in FIG. 2. In the closed position, the underside of the lid 12 can push down on the valve 10 and keep it folded down with the tube 22 sealed.

In the position shown in FIG. 4, the valve 10 is in a selectively open position where it can act as a bite valve. In this position, the valve 10 is sealed until a user squeezes the valve, such as with their teeth, causing a seal at the upper end of the valve to open and allow fluid to flow out. From the selectively open position shown in FIG. 4, a portion of the valve 10 can be twisted to cause the valve to move to a fully open position, as shown in FIGS. 5 and 6, such that fluid is freely allowed to flow through the valve 10.

Figure 9:
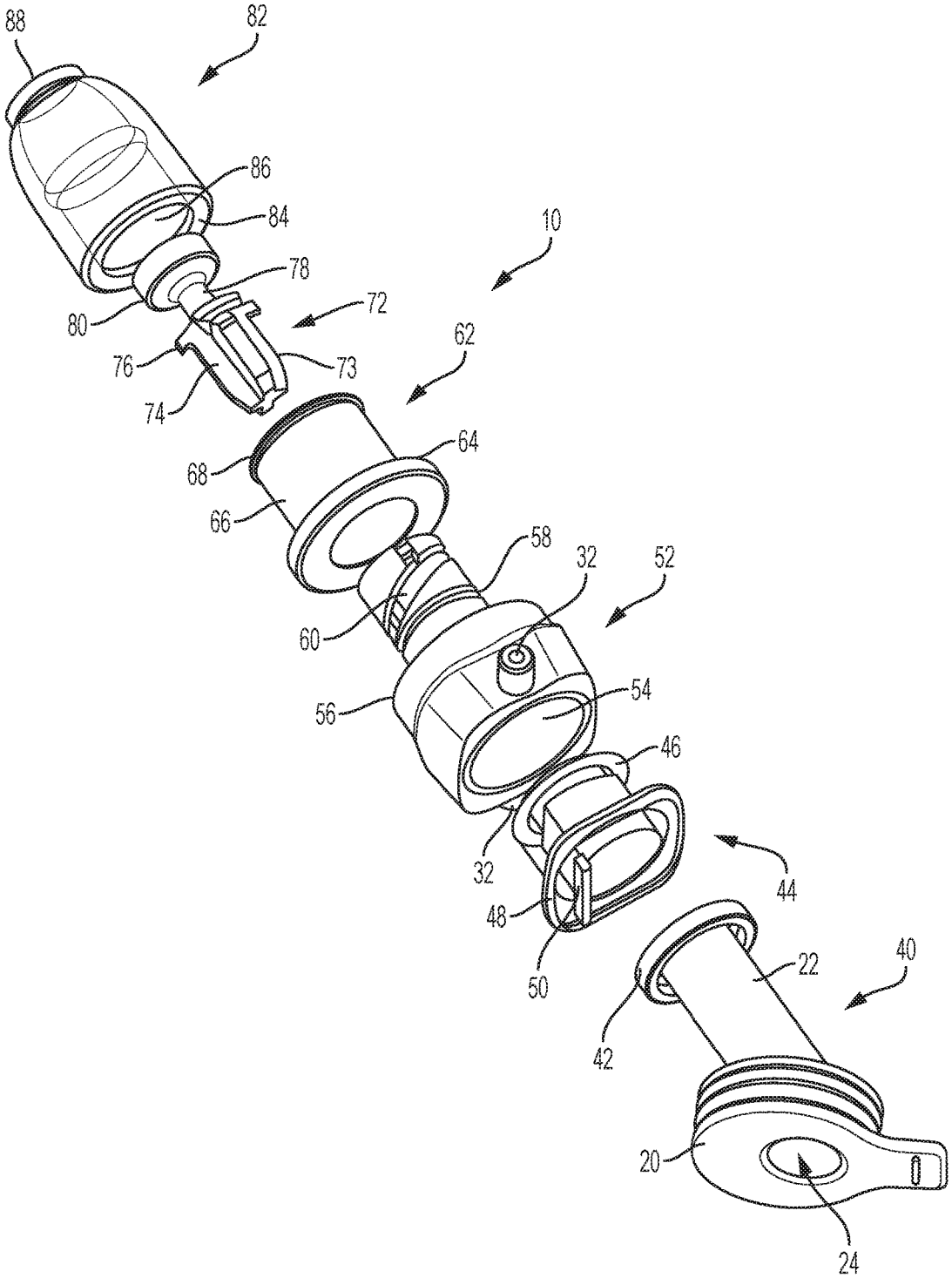
FIGS. 9 and 10 are exploded perspective views of an exemplary multi-position valve.
Figure 10:
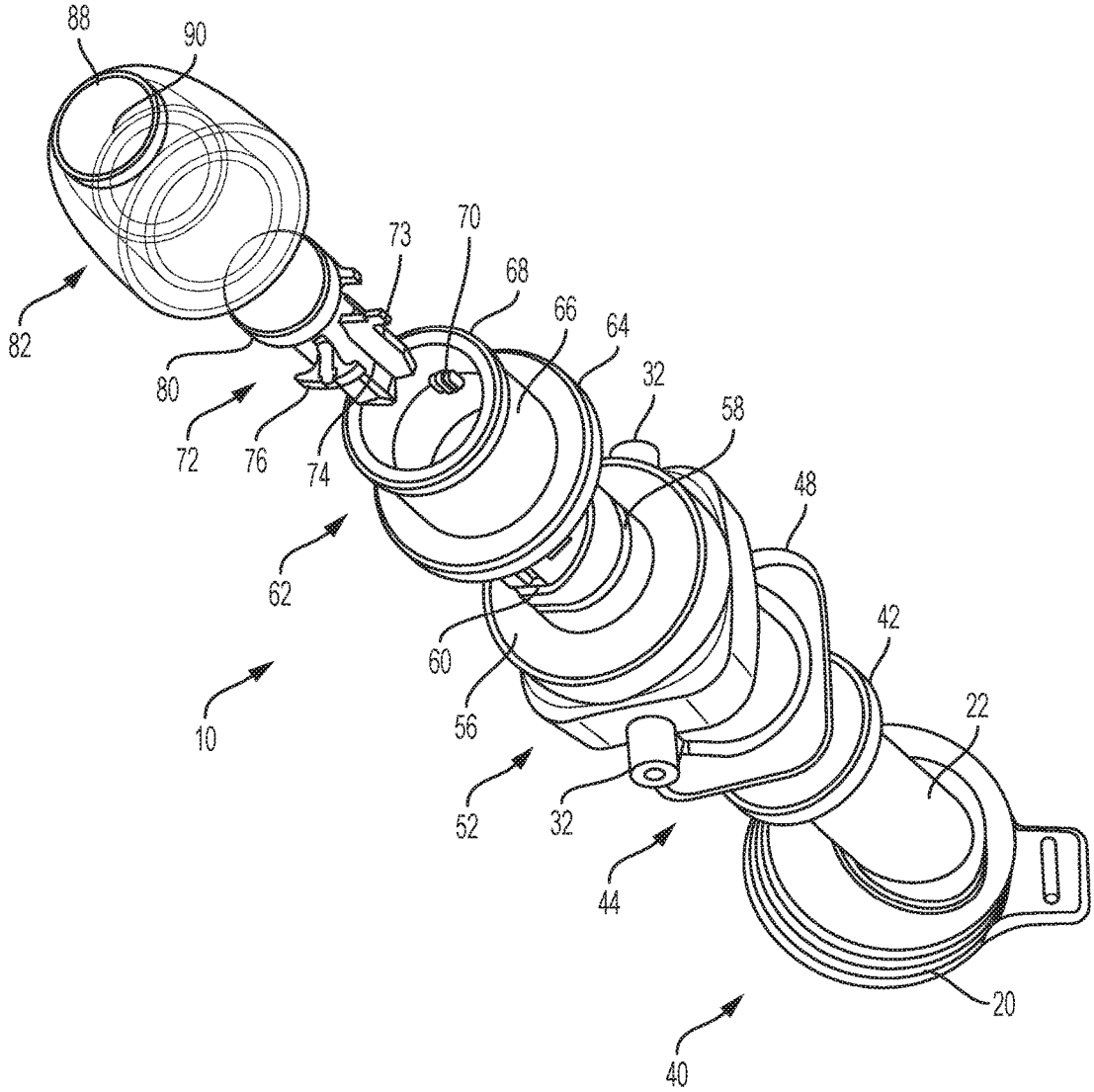
Figure 11:
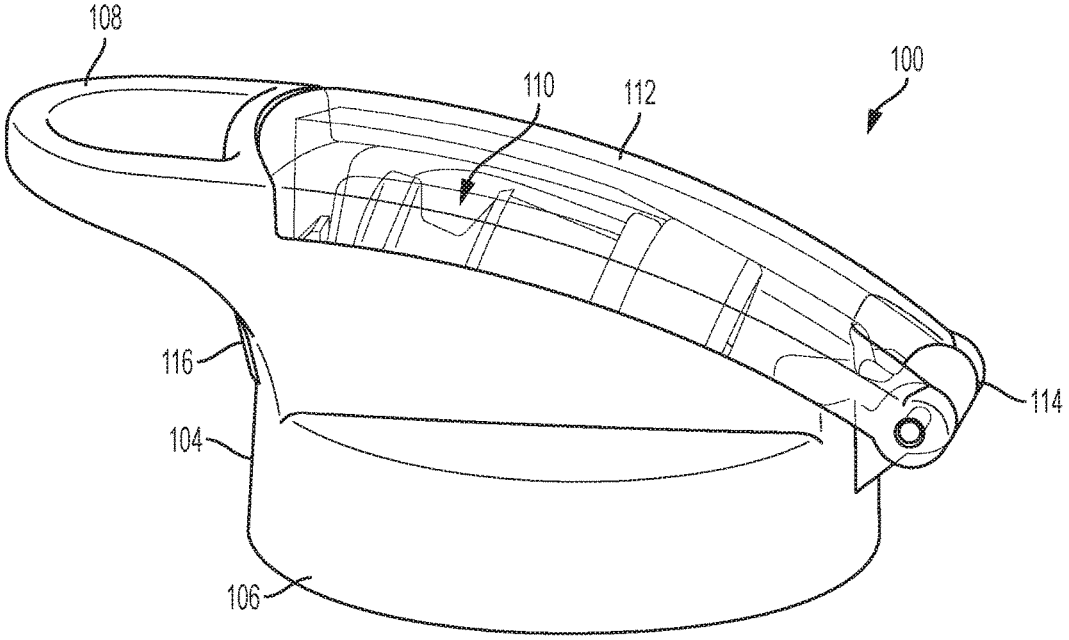
FIG. 11 is a side view of another exemplary bottle cap having a multi-position valve, shown in a closed position.

FIGS. 9 and 10 are exploded views that illustrated the various components and features of the valve 10. A flexible connector 40 includes the tube 22, the lower seal 20, the lower fluid inlet 24, and an upper flange 42. The flexible connector 40 can be made of a resiliently deformable material, such as rubber or other polymeric materials, which allows the tube 22 to collapse and re-open repeatedly. The upper end of the tube 22 extends through a rigid tube anchor 44 with the upper flange 42 extending around an upper rim 46 of the tube anchor. The tube anchor 44 can be positioned within an internal passage 54 of a rigid valve base 52 such that a lower flange 48 of the tube anchor 44 sits against or just below a lower surface of the valve base 52 and the upper flange 42 of the flexible connector 40 is held between the upper rim 46 of the tube anchor and an internal wall of the valve base 52, thereby anchoring the flexible connector 40 to the valve base 52. The upper flange 42 can also act as an O-ring to seal the interface between the flexible connector 40 and the valve base 52. The tube anchor 44 can also include a lower ridge 50 that can protrude into the tube 22 in the closed position to help fully collapse the tube along with the lower flange 48 (see FIG. 2).

The valve base 42 includes pivots 32, or equivalent features, on opposite lateral sides that engage with the base 4 of the cap 2 and allow the valve 10 to pivot relative to the base. The valve base 42 also supports a rigid collar 62, a rigid stem 72, and a flexible sheath 82 that together form an adjustable bite valve. The collar 62 is adjustably mounted around an upper end of the valve base. The collar 62 includes a lower rim 64 that contacts a surface 56 on the valve base 52 in the selectively open position (FIG. 4) and is spaced from the surface 56 in the fully open position (FIG. 5). The collar 62 can have one or more internal guide pins 70 (FIG. 10) that project radially into one or more corresponding helical grooves 60 in the valve base 52. The engagement between the pins 70 and the grooves 60 causes the collar 62 to move axially relative to the valve base 52 as the collar and sheath 82 are manually rotated relative to the valve base. Twisting the collar 62 and sheath 82 in one direction causes the collar and sheath to move axially away from the valve base 52, and twisting the collar and sheath the opposite direction causes the collar and sheath to move axially toward the valve base. The valve base 52 can also include an annular groove 58 that receives an O-ring to seal the interface between the collar and the valve base.

The rigid stem 72 includes a base 73 that inserts into the upper end of the valve base 52, a neck 78, and a head 80 that seals against the inside of the sheath 82. The base 73 includes axially aligned grooves 74 that allow fluid to flow through the valve base and past the base 73 and into the sheath 82. The base 73 can also include flanges 76 that contact the upper end of the valve base 52 to limit its insertion depth into the valve base.

The sheath 82 can be comprised of a resiliently flexible material that allows the sheath the repeatedly flex and return to its natural rounded shape as shown FIGS. 9 and 10. A lower internal surface 86 of the sheath 82 is mounted on an outer surface 66 of the collar such that the lower end of the sheath can abut the lower rim 64 of the collar. An upper rim 68 of the collar can engage with the internal groove 90 (FIG. 10) of the sheath to provide sealing and to fix the sheath in position relative to the collar 62 such that the sheath and collar move axially and rotationally in unison.

In the selectively open position, the broad head 80 of the stem 72 seals against an outlet 88 of the sheath in its natural undeformed state to block fluid from exiting the valve 10. However, a user can bite down on the sheath (or otherwise squeeze the sheath) just below the head 80 around the neck 78 to cause the outlet 88 of the sheath separate from the head 80 and form a passage for fluid to flow out of the valve 10.

When the sheath 82 and collar 62 are twisted relative to the valve base 52, the sheath and collar move axially away from the valve base to the fully open position. This causes the outlet 88 of the sheath to move axially above the head 80 of the stem 72 and causes a portion of the sheath with a larger inner diameter to move over the head 80 such that an annular space is formed between the head and the internal surface of the sheath. This creates an open flow path around the head and out through the outlet 88. Fluid can then flow from a bottle, through a straw and/or filter (not shown), into the inlet 24 and through the tube 22 of the flexible connector 40, through the internal passage 54 of the valve base 52, through the axial grooves 74 in the stem base 73, between the head 80 and the sheath 82, and out through the outlet 88.

In some embodiments, when the valve 10 is pivoted to the selectively open position or fully open position (see FIG. 6), the flange 31 extending from the pivot joint 30 can become lodged under the lower flange 48 of the tube anchor 44 to lock the valve 10 in that position. This prevents the valve 10 from pivoting backward toward the closed position until the user moves the lid 12 upward and rearward, thereby causing the arms 34 and the flange 31 to pivot backward and releasing the flange 31 from below the flange 48.

More information regarding bite valves and multi-position valves can be found in U.S. Pat. No. 6,039,305, issued on Mar. 21, 2000, and U.S. Provisional Patent Application No. 61/927,865, filed on Jan. 15, 2014, both of which are hereby incorporated by reference herein in their entirety.

Figure 15:
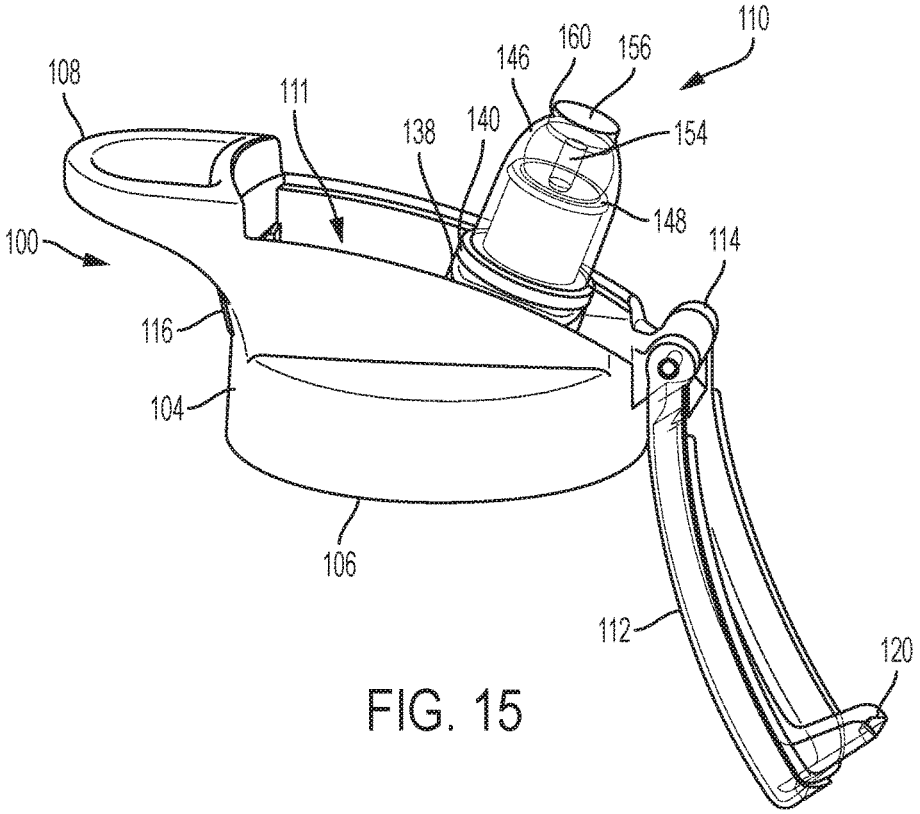
FIG. 15 is a side view of the bottle cap of FIG. 11 in a selectively open position wherein the valve can function as a bite valve to dispense fluid.
Figure 16:
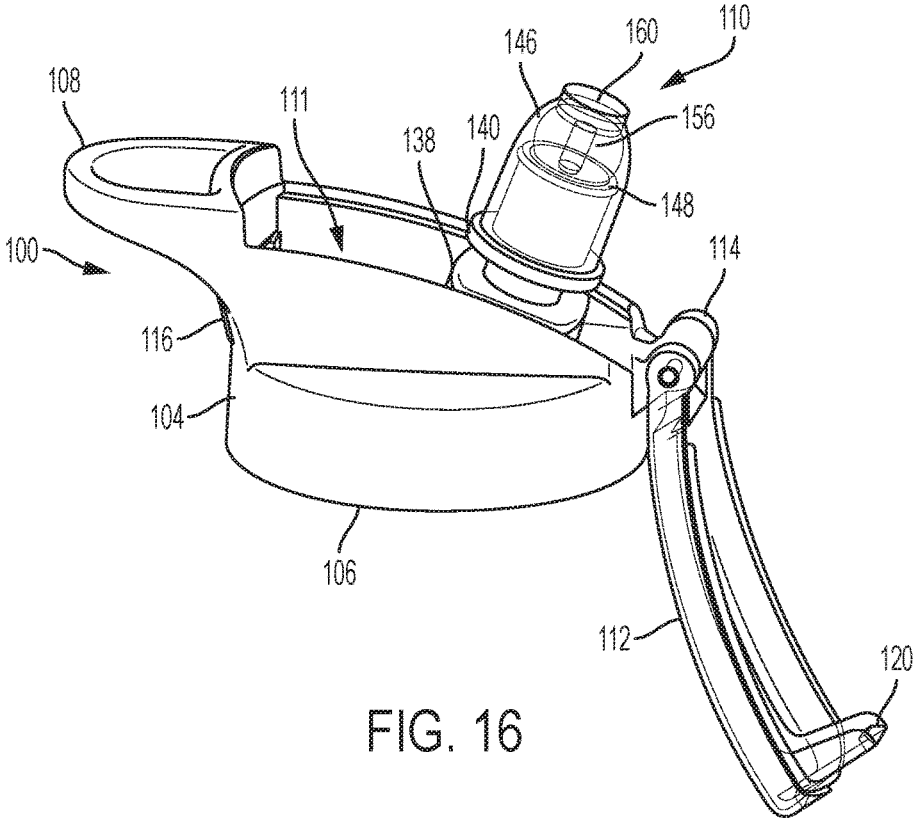
FIG. 16 is a perspective view of the bottle cap of FIG. 11 in a fully open position wherein the fluid can freely flow through the valve.
Figure 17:
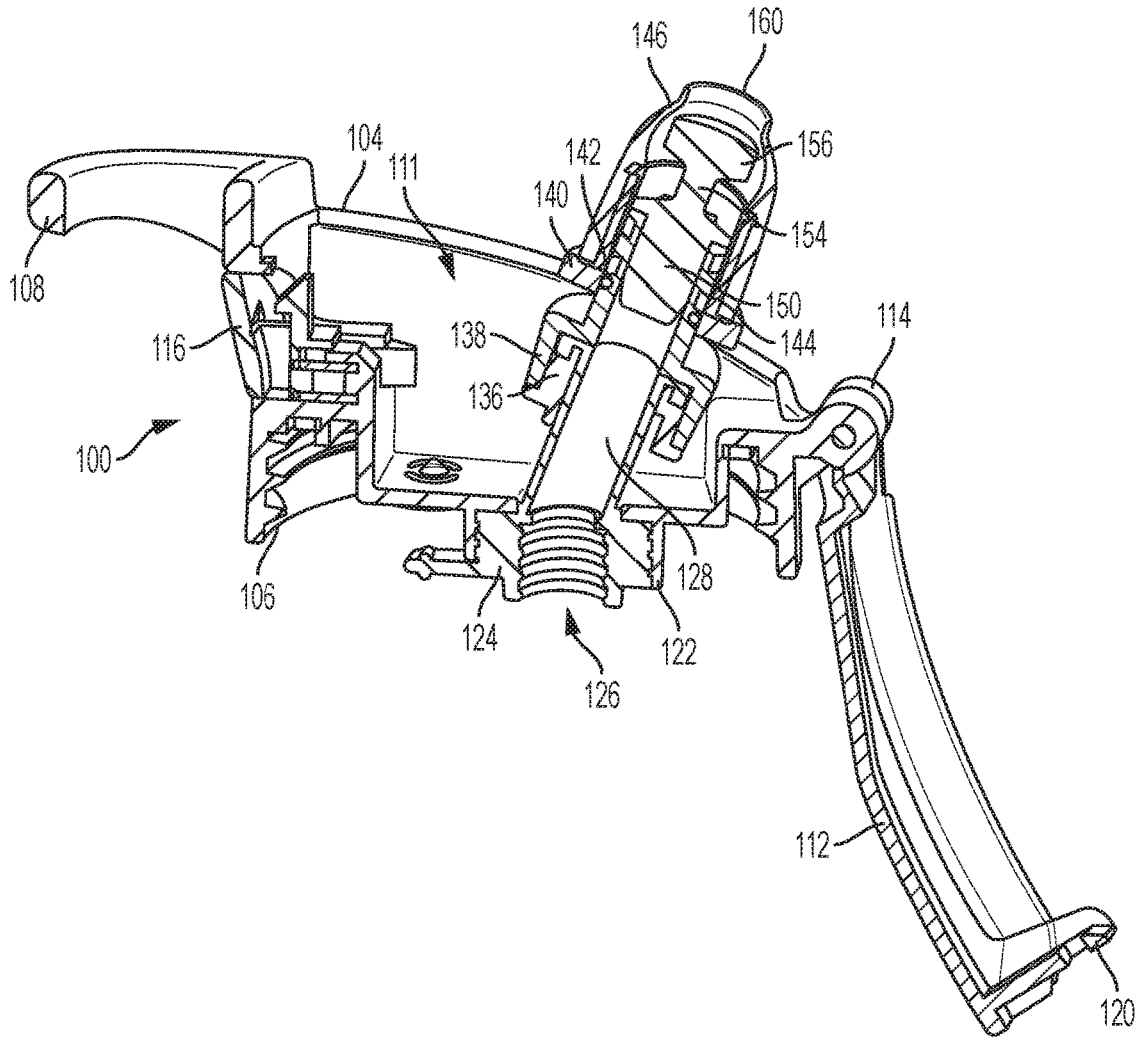
FIG. 17 is a cross-sectional view of the bottle cap of FIG. 16 in the fully open position.

FIGS. 11-17 show another exemplary bottle cap 100 with a multi-position valve in various operative positions. FIGS. 11-14 show the cap 100 with valve 110 in a closed position, FIG. 15 shows the valve in a selectively open position, and FIGS. 16-17 show the valve in a fully open position.

Figure 12:
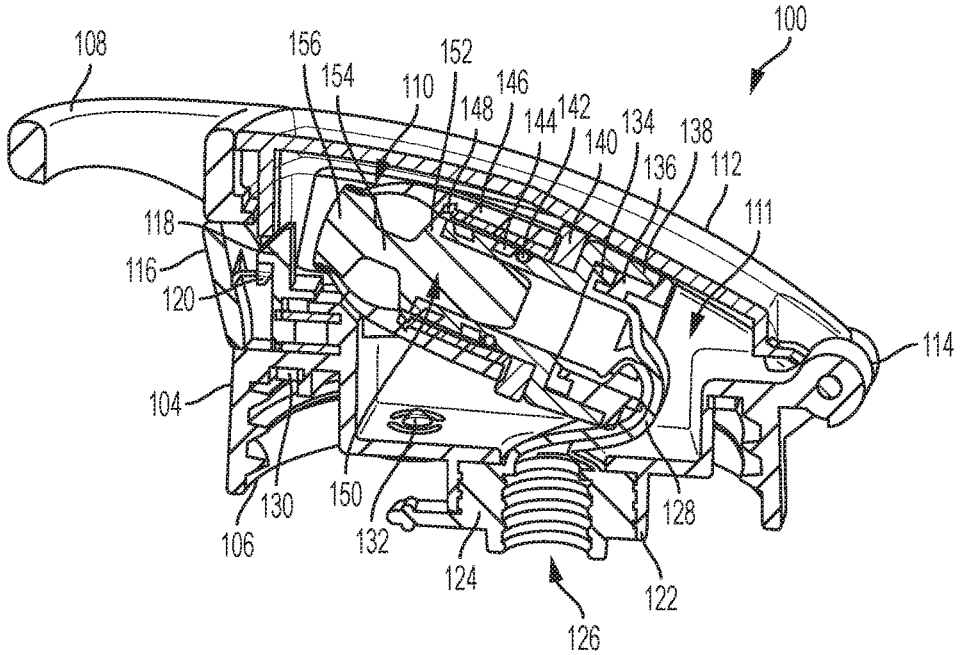
FIG. 12 is a cross-sectional view of the bottle cap of FIG. 11 in the closed position.
Figure 13:
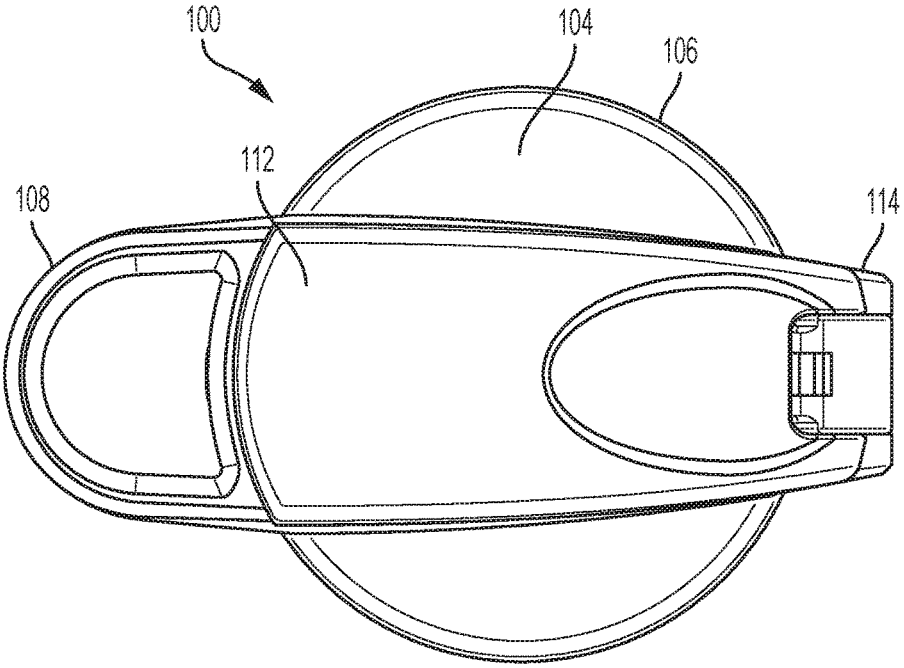
FIG. 13 is a top view of the bottle cap of FIG. 11 in the closed position.
Figure 14:
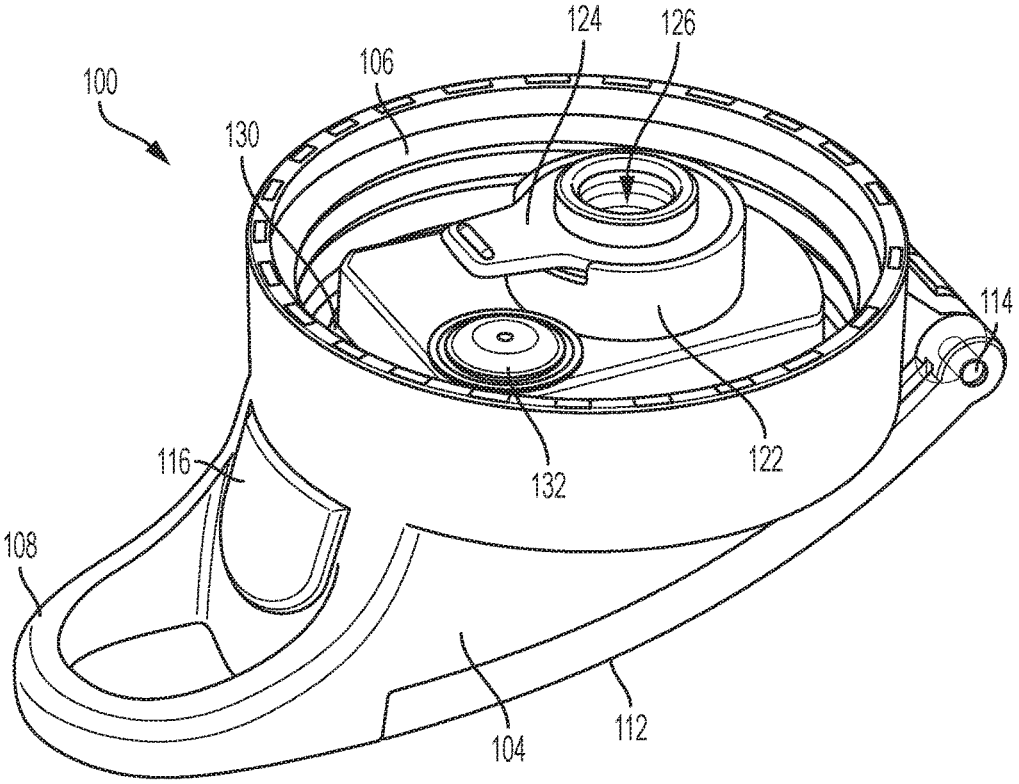
FIG. 14 is a bottom perspective view of the bottle cap of FIG. 11 in the closed position.

The cap 100 comprises a rigid body 104 having a threaded lower opening 106 for attaching to an upper opening of a bottle, an optional handle 108, the adjustable valve 110, and a lid 112. As shown in FIG. 12, the cap 100 further includes a flexible, collapsible tube 128 that extends from the base of the valve 110 to a lower fluid inlet 126 adapted to be coupled to a filter and/or a straw that extends down into a bottle to access fluid therein. The lower end of the tube 128 includes a seal 124 that seats within an annular collar 122 of the body, as is illustrated in the bottom view of FIG. 14. The cap 100 can also include an air vent and umbrella valve 132 in the body 104 that allows air to enter a bottle through the cap but prevents fluid from escaping. The cap 100 can also include a gasket 130 above the threaded opening 106 to help seal the cap to a bottle to prevent leaks.

In the closed position of FIGS. 11-14, the valve 110 is tucked into a cavity 111 in the body 104 and the lid 112 is closed. As shown in FIG. 12, the tube 128 collapses in the closed position such that fluid flow through the tube is blocked. The tube 128 can be pinched between a surface of the valve 110 and a surface of the body 104 to collapse the tube. In the closed position, the lid 112 covers the cavity 111 and the valve 110.

To move from the closed position to the selectively open position shown in FIG. 15, the lid 112 can be pivoted about a forward hinge 114 to the position shown in FIGS. 15-17, which allows the valve 110 to pivot to upwardly and forwardly out of the cavity 111 to the position shown in FIG. 15. As shown in FIG. 12, the lid 112 can include a locking tab 120 at the end of the lid opposite from the hinge 114 that is configured to engage with a latch 118 of a release button 116 mounted in the rear of the body 104 when the lid is closed. When the locking tab 120 is engaged with the latch 118, the lid 112 is held in the closed position and the lid holds the valve 110 in the folded down closed position shown in FIG. 12. To open the lid, a user can press the release button 116 to free the latch 118 from the locking tab 120. Once unlocked, resilient forces from the valve 110 can urge the lid 112 open and cause the valve to pop up to the position of FIG. 15.

In some embodiments, the valve 110 can pivot relative to the body 104 about pivots (not shown) on either side of the valve 110, which can be similar to the pivots 32 shown in FIG. 3. In other embodiments, the valve 100 can simply hinge at the flexible tube 128.

To move back to the closed position, the user can pivot the lid 112 back to the closed position, and the lid can contact the valve 110 can push the valve back into the cavity 111. Alternatively, the user can manually push the valve 110 back into the cavity 111, and then close the lid 112.

In the position shown in FIG. 15, the valve 110 is in a selectively open position where it can act as a bite valve. In this position, the valve 110 is sealed until a user squeezes the valve, such as with their teeth, causing a seal at the upper end of the valve to open and allow fluid to flow out. From the selectively open position shown in FIG. 15, a portion of the valve 110 can be twisted to cause the valve to move to the fully open position shown in FIGS. 16-17, such that fluid is freely allowed to flow through the valve 110.

The valve 110 can be constructed similarly to the valve 10 and can function similarly to the valve 10. A flanged upper end 134 of the flexible tube 128 is anchored to a rigid valve base 138 via a rigid tube anchor 136. The tube 128 extends through the tube anchor 136 with the upper flange 134 extending around an upper rim of the tube anchor. The tube anchor 136 can be positioned within an internal passage of the valve base 138 such that a lower flange of the tube anchor sits against or just below a lower surface of the valve base and the upper flange of the tube is held between the upper rim of the tube anchor and an internal wall of the valve base, thereby anchoring and sealing the flexible tube to the valve base. The tube anchor 138 can also include a lower projection that can protrude into the tube 128 in the closed position to help fully collapse the tube (see FIG. 12).

The valve base 138 supports a rigid collar 140, a rigid stem 150, and a flexible sheath 146 that together form an adjustable bite valve. The collar 140 is adjustably mounted around an upper end of the valve base. The collar 140 can have one or more internal guide pins (similar to guide pins 70) that project radially into one or more corresponding helical grooves 144 in the valve base 138 (similar to grooves 60). The engagement between the guide pins and the grooves causes the collar to move axially relative to the valve base as the collar and sheath are manually rotated relative to the valve base. Twisting the collar and sheath in one direction causes the collar and sheath to move axially away from the valve base, and twisting the collar and sheath the opposite direction causes the collar and sheath to move axially toward the valve base. The valve base can also include an annular groove that receives an O-ring 142 (FIG. 12) to seal the interface between the collar and the valve base.

The rigid stem 150 is inserted into the upper end of the valve base 140. The stem 150 can include axially aligned grooves (similar to grooves 74) that allow fluid to flow through the valve base 138 and past the stem and into the sheath 146. The stem 150 can also include flanges 152 that contact the upper end of the valve base 138 to limit its insertion depth into the valve base.

The sheath 146 can be comprised of a resiliently flexible material that allows the sheath the repeatedly flex and return to its natural rounded shape. An internal surface of the sheath 146 is mounted on an outer surface of the collar 140. An upper rim 148 of the collar can engage with the internal groove in the sheath to provide sealing and to fix the sheath in position relative to the collar such that the sheath and collar move axially and rotationally in unison.

In the selectively open position (FIG. 15), the broad head 156 of the stem 150 seals against an outlet 160 of the sheath in its natural undeformed state to block fluid from exiting the valve 110. However, a user can bite down on the sheath (or otherwise squeeze the sheath) just below the head 156 around the neck 154 of the stem to cause the outlet 160 of the sheath separate from the head 156 and form a passage for fluid to flow out of the valve 10.

When the sheath 146 and collar 140 are twisted relative to the valve base 138, the sheath and collar move axially away from the valve base to the fully open position. This causes the outlet 160 of the sheath to move axially above the head 156 and causes a portion of the sheath with a larger inner diameter to move over the head such that an annular space is formed between the head and the internal surface of the sheath. This creates an open flow path around the head and out through the outlet 160. Fluid can then flow into the inlet 126, through the tube 128, through the internal passage of the valve base 138, through axial grooves in the stem 150, between the head 156 and the sheath 160, and out through the outlet 160.

Figure 18:
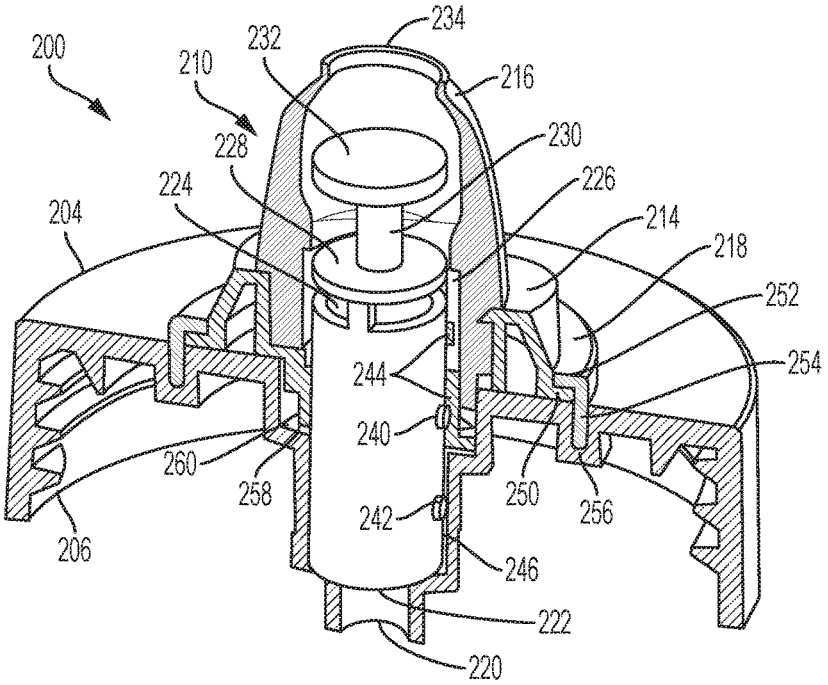
FIG. 18 is a partially cross-sectional perspective view of another exemplary bottle cap.
Figure 19:
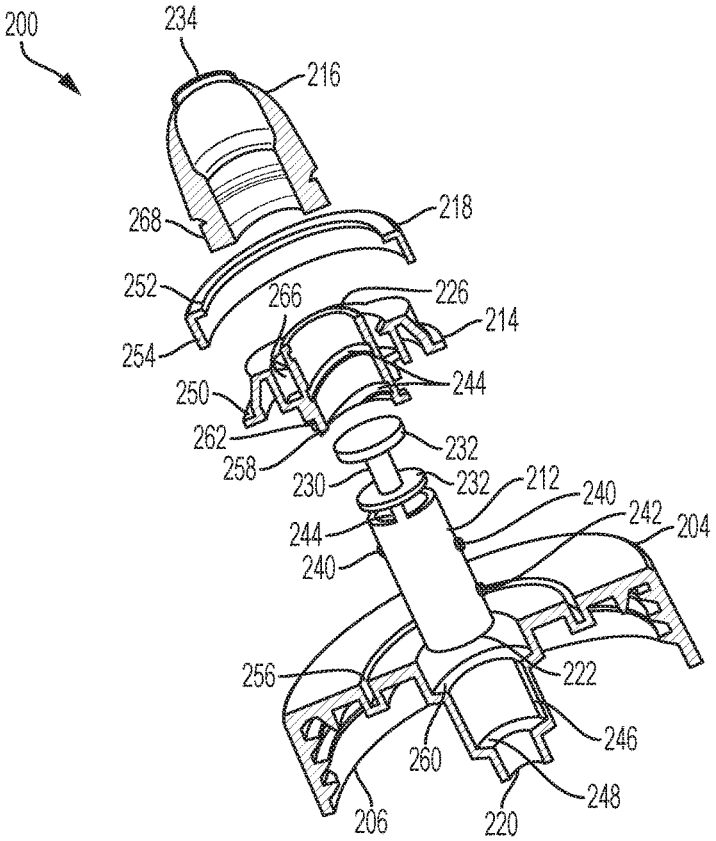
FIG. 19 is an exploded view of the bottle cap of FIG. 18.
Figure 20:
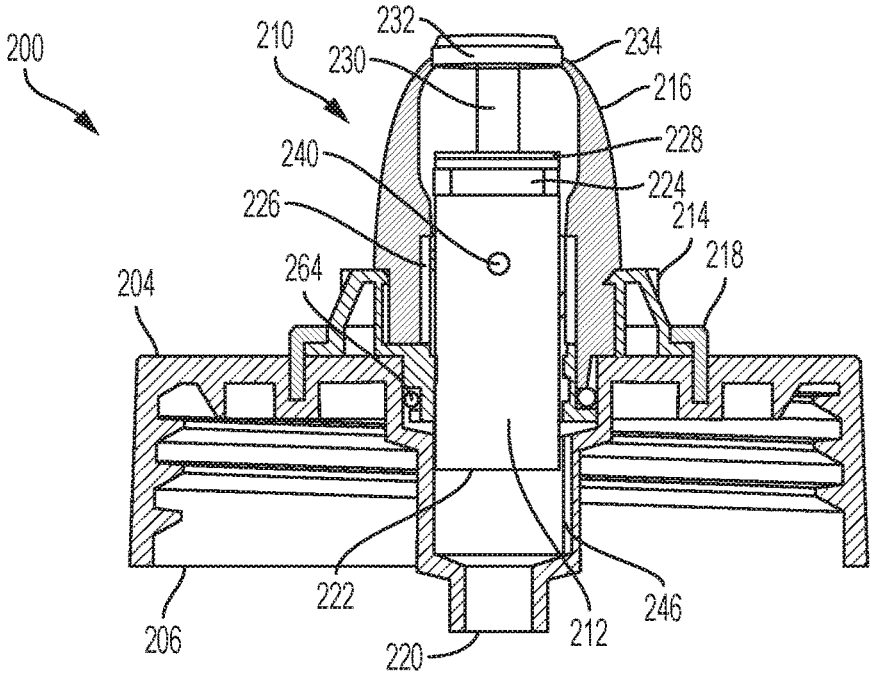
FIG. 20 is a partially cross-sectional side view of the bottle cap of FIG. 18 in a selectively open position.
Figure 21:
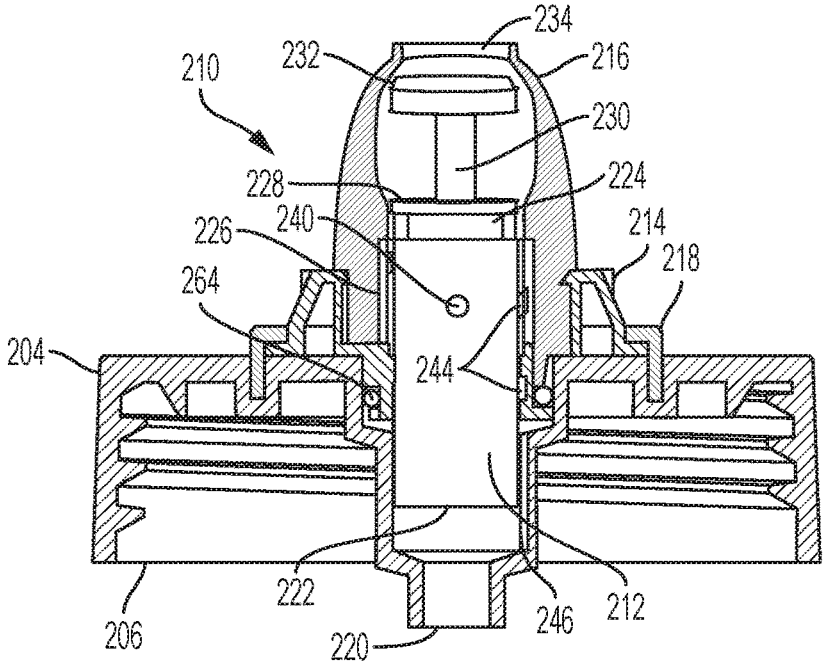
FIG. 21 is a partially cross-sectional side view of the bottle cap of FIG. 18 in a fully open position.
Figure 22:
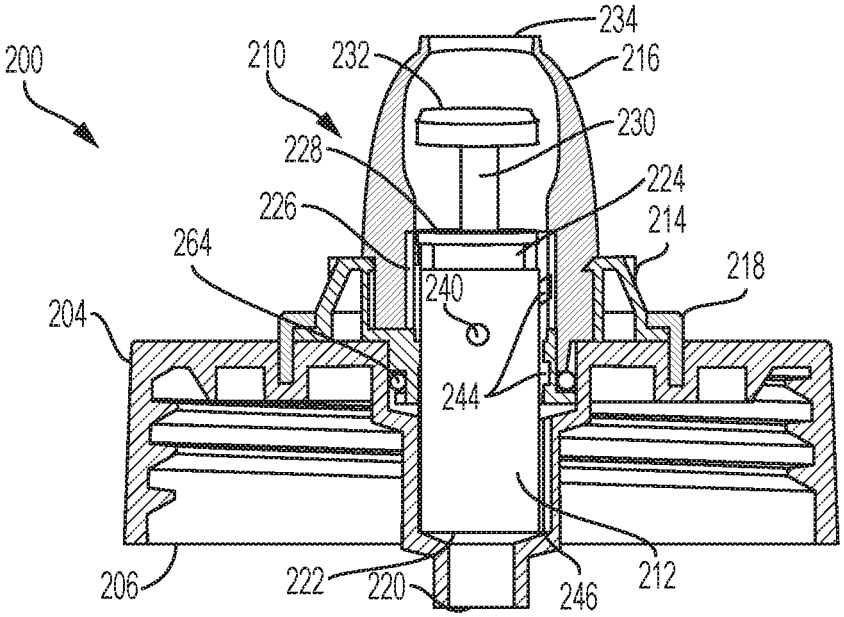
FIG. 22 is a partially cross-sectional side view of the bottle cap of FIG. 18 in a closed position.

FIGS. 18-22 show another exemplary bottle cap 200 with a multi-position valve in various operative positions. FIGS. 18-22 shows most of the cap 200 in cross-section, but with an internal stem 212 shown not in cross-section. FIG. 19 is an exploded view. FIGS. 18 and 22 show a closed position, FIG. 21 shows a fully open position, and FIG. 20 shows a selectively open position.

The cap 200 includes a base 204 having a lower threaded opening 206 for securing to a bottle, the stem 212, a knob 214, a sheath 216, and a collar 218. The stem 212 and the sheath 216 cooperate to form an adjustable bite valve 210. In the fully open or selectively open positions (see FIGS. 20 and 21), fluid can flow in through a lower inlet 220 in the base, through a lower opening 222 in the stem, through an internal passage through the stem, out of the stem through radial openings 224 into the sheath 216, around the head 232 of the stem, and out through upper outlet 234 of the sheath. The lower inlet 220 can be coupled to a straw, filter, and/or other objects.

The stem 212 is movable vertically by rotating the knob 214. The knob 214 is held to the base 204 by the collar 218, which restricts the knob from moving vertically or laterally. The collar 218 includes an inner rim 252 to overlies out outer rim 250 of the knob 214, and the collar also includes a lower rim 254 that is inserted in an annular groove 256 of the base to fix the collar to the base while allowing the knob to rotate about a vertical axis of the cap. A lower rim 258 of the knob 214 is positioned in a recess 260 of the base 204, and the interface therebetween can be sealed by an O-ring 264, as shown in FIGS. 20-22. The knob 214 also includes an annular inner wall 226 that covers the radial openings 224 of the stem in the closed position to block fluid flow. The sheath 216 includes a lower flange 268 that is mounted in an annular recess 266 (FIG. 19) surrounding the inner wall 226, such that the sheath 216 rotates along with the knob 214.

The stem 212 includes one or more radially extending pins 240 that are engaged in one or more corresponding helical grooves 244 on the inner surface of the knob 214. The stem 212 also includes one or more radially extending pins 242 that are engaged in one or more corresponding vertical grooves 246 in the inner surface of the base 204. These pin-and-groove interfaces cause the stem 212 to move vertically, but not rotationally, when the knob 214 is rotated. Rotation of the knob 214 in one direction causes the helical grooves 244 to push the pins 240 and the rest of the stem upwardly, while the vertical grooves 246 restricts the pins 242 and the rest of the stem from rotating along with the knob. Rotation of the knob 214 in the opposite direction causes the helical grooves 244 to push the pins 240 and the rest of the stem downwardly, while the vertical grooves 246 restricts the pins 242 and the rest of the stem from rotating along with the knob.

When the stem 212 is adjusted to a lower position (e.g., the closed position, as shown in FIG. 22), the lower end of the stem 222 can be close to or touching a lower wall 248 (FIG. 19) of the base, which blocks further downward vertical motion of the stem. In the closed position, the radial openings 224 of the stem 212 are positioned below the top end of the annular inner wall 226 of the knob, and an disk-shaped upper wall 228 of the stem can seat sealingly within the inner wall 226 to block fluid flow from within the stem into the sheath 216. In alternative embodiments, the upper wall 228 of the stem can be larger in diameter and can seat sealingly against the top of the inner wall 226 instead of inside of the inner wall. In some embodiments, a gasket or O-ring can be added to the inner wall 226 or the upper wall 228 to provide a better seal therebetween.

From the closed position, rotating the knob 214 causes the stem 212 to move up to the fully open position shown in FIG. 21. In this position, the upper wall 228 and radial openings 224 of the stem are positioned above the inner wall 226 of the knob 214 such that fluid can flow through the radially openings 224, around the upper wall 228, and into the open space within the sheath 216. The head 232 of the stem is positioned below the upper outlet 234 of the sheath with a radial space between the head 232 and the surrounding walls of the sheath, such that fluid can freely flow around the head 232 and out through the outlet 234.

From the open position, rotating the knob 214 further causes the stem 212 to move up to the selectively open position shown in FIG. 20. In this position, the upper wall 228 and radial openings 224 of the stem are positioned above the inner wall 226 of the knob 214 such that fluid can flow through the radially openings 224, around the upper wall 228, and into the open space within the sheath 216. The head 232 of the stem is positioned sealingly within the upper outlet 234 of the sheath, such that the sheath and stem form a bite valve. In this position, squeezing the sheath (e.g., biting down on the sheath) around the neck 230 of the stem causes the sheath to distort and causes separation between the upper outlet of the sheath and the head 234 of the stem so that fluid can flow out of the sheath through the upper outlet 234.

Figure 23:
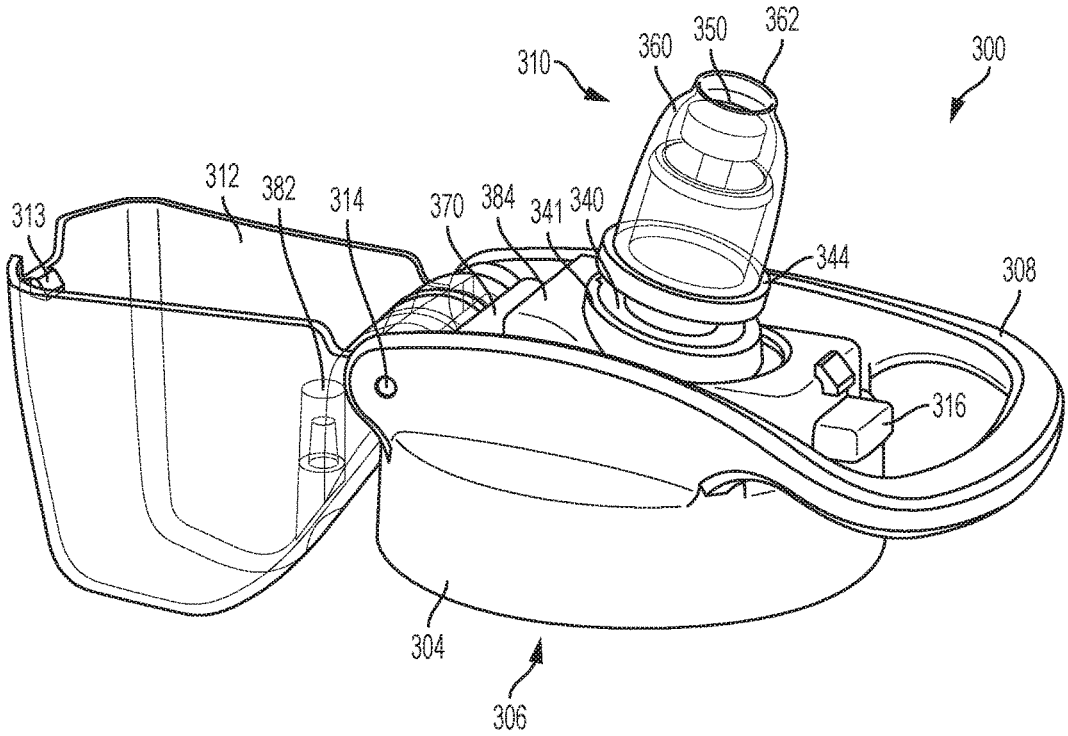
FIG. 23 is a side perspective view of another exemplary bottle cap having a multi-position valve, shown in a fully open position wherein the fluid can freely flow through the valve.
Figure 24:
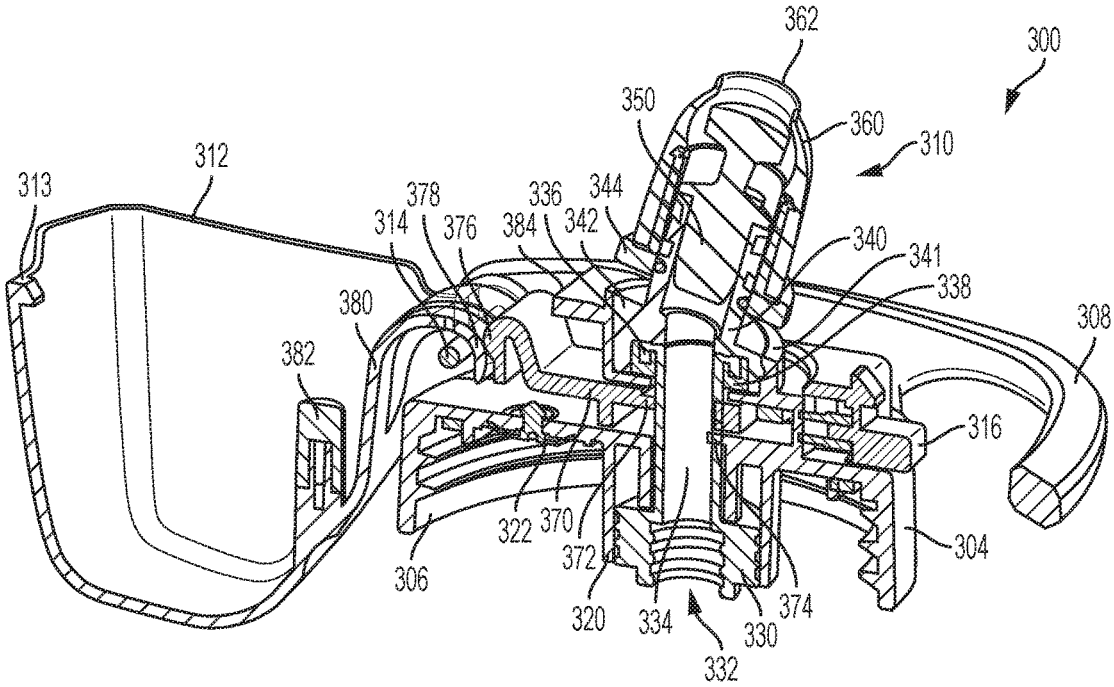
FIG. 24 is a cross-sectional view of the bottle cap of FIG. 23 in the fully open position.

FIGS. 23 and 24 show another exemplary bottle cap 300 with a multi-position valve in various operative positions. FIGS. 23 and 24 show the cap 300 in a fully open position. The cap 300 can also be adjusted to a selectively open bite valve position (not shown) by twisting the sheath 360 and collar 344, and placed in a closed position by closing the cap 312 (not shown).

The cap 300 comprises a rigid body 304 having a threaded lower opening 306 for attaching to an upper opening of a bottle, an optional handle 308, the adjustable valve 310, and a lid 312. The cap 300 further includes a flexible, collapsible tube 334 that extends from the base of the valve 310 to a lower fluid inlet 332 adapted to be coupled to a filter and/or a straw that extends down into a bottle to access fluid therein. The lower end of the tube 432 includes a seal 330 that seats within an annular collar 320 on the bottom of the body. The cap 300 can also include an air vent and umbrella valve 322 in the body 304 that allows air to enter a bottle through the cap but prevents fluid from escaping.

The adjustable valve 310 includes a rigid valve base 340 having a lower portion 342 mounted in an annular upper collar 341 of the body 304, a rigid collar 344 adjustably mounted on the upper end of the valve base 340, a rigid stem 350 mounted in the upper end of the valve base, and a flexible sheath 360 mounted on the collar and around the stem, which together form an adjustable bite valve that is similar in structure and function to the adjustable bite valves of the valves 10, 110, and 210. The lower portion 342 of the valve base 340 can be coupled to a flanged upper end 336 of the tube via a tube anchor 338 that mounts fittingly inside a recess in the lower portion 342 of the valve base to create a seal between the tube 334 and the valve base 340.

From the fully open position shown in FIGS. 23 and 24, the sheath 360 and collar 344 can be twisted relative to the valve base 340 to adjust the valve 310 to a selectively open position wherein the outlet 362 of the sheath 360 seals around the head of the stem 350 until a user squeeze the sheath, such as with their teeth, to open the valve and allow fluid flow.

The cap 300 can also be adjusted to a closed position by pivoting the lid 312 relative to the body 304 about pivot axis 314 until a tab 313 on the lid engaged with a releasable locking mechanism 316 on the opposite side of the cap. The lid 312 forms a cavity large enough to cover the valve 310 in the closed position without contacting the valve or with minimal contact. In the closed position, a projection 384 on the inside of the lid can contact a stationary surface 384 of the body 304 to limit the pivoting motion of the lid in the closing direction. Thus, in this embodiment, the valve 310 does not pivot or fold down in order for the cap to move to the closed position, but instead the valve 310 remains projecting upright at all times, such as at the angle illustrated or at any other desired orientation.

As the lid 312 pivots toward the closed position, the lid causes a reciprocating slider 370 to slide laterally/forwardly relative to the body 304 toward the locking mechanism 316 such that a pinching surface 372 of the slider pushes into a sidewall of the tube 334 and collapses the tube between the pinching surface 372 and an opposing stationary surface 374 of the body 304 on the opposite side of the tube. The surface 372 and the surface 374 can be offset vertically from each other to cause the tube 334 to kink as it collapses to provide a better seal inside the tube.

A rear surface 376 of the slider 370 is in contact with a rounded surface of the lid that extends approximately between points 378/380. This rounded surface of the lid increases in radial distance from the pivot axis 314 moving from point 378 toward point 380. When the lid is fully open as shown, the point 378 contacts the surface 376 of the slider and allows the slider to move to its most rearwardly position, as shown, which corresponds to a position of the surface 372 that allows the tube 334 to be fully open and allow fluid flow. As the lid pivots about axis 314, the radial distance from the axis 314 to the point that contacts the surface 376 increases, which drives the slider forward and causes the surface 372 to impinge into the tube 334. As the lid reaches the closed position, the point 380 with the maximum radius is in contact with the surface 376 of the slider, such that the surface 374 fully impinges on the tube 334 and seals off the tube to prevent fluid flow. When the lid 312 is opened by pressing a release button on the locking mechanism 316, the opposite process occurs to allow the slider 380 to move rearwardly and allow the tube 334 to open. In some embodiments, the resiliency of the tube can be sufficient to cause the slider to move back rearwardly, while in other embodiments, a spring or other biasing mechanism can be includes that biases the slider relative to the body 304 toward the rearward position shown.

Many of the features described in connection with particular embodiments disclosed herein can similarly be included in one or more of the other embodiments disclosed herein. Thus, any features disclosed herein should be construed to be applicable to any of the embodiments disclosed herein, or any other equivalent alterative embodiments not explicitly disclosed, unless not possible or explicitly described otherwise.

As used herein, the singular terms "a", "an", and "the" include plural referents unless context clearly indicates otherwise. The term "comprises" means "includes without limitation." The term "coupled" means physically linked and does not exclude intermediate elements between the coupled elements. The term "and/or" means any one or more of the elements listed. Thus, the term "A and/or B" means "A", "B" or "A and B."

The disclosed embodiments are illustrative only and not intended to be limiting. Although articles and methods similar or equivalent to those described herein can be used in various alternative embodiments of the present technology, only certain suitable embodiments and equivalent features are described herein.

In view of the many possible embodiments to which the principles of the disclosed technology may be applied, it should be recognized that the illustrated embodiments are only examples and should not be taken as limiting the scope of the disclosure. Rather, the scope of the disclosure is at least as broad as the following claims. Applicant therefore claims all that comes within the scope of these claims.

The invention claimed is:

1. A bottle cap comprising:

a rigid body that is securable to an opening of a bottle;

a multi-position valve coupled to the rigid body and operable to regulate fluid flow through the bottle cap; and a lid coupled to the rigid body;

wherein the bottle cap is adjustable between at least a closed position, a selectively open position, and a fully open position, wherein:

when the bottle cap is in the closed position, the lid covers the multi-position valve and fluid flow through the multi-position valve is prevented;

when the bottle cap is in the selectively open position, the lid is uncovered from the multi-position valve, the multi-position valve opens to allow fluid flow through the bottle cap when a flexible portion of the multi-position valve is engaged by a user, and the multi-position valve remains closed to block fluid flow through the bottle cap when the flexible portion is not engaged by the user; and when the bottle cap is in the fully open position, the lid is uncovered from the multi-position valve and the multi-position valve remains open to allow fluid through the bottle cap whether or not the flexible portion is engaged by the user.

2. The bottle cap of claim 1, wherein when the bottle cap is in the selectively open position, the multi-position valve is operable as a bite valve such that the user can selectively open the multi-position valve to permit fluid flow through the bottle cap by biting on the flexible portion of the multi-position valve.

3. The bottle cap of claim 1, wherein the multi-position valve comprises a flexible tubular portion that is collapsed to prevent fluid flow through the tubular portion in the closed position, and open to allow fluid flow through the tubular portion in the selectively open position and in the fully open position.

4. The bottle cap of claim 1, wherein the multi-position valve is pivotably coupled to the rigid body of the bottle cap and the multi-position valve is pivotable between a folded down position when the bottle cap is in the closed position and an unfolded position when the bottle cap is in the selectively open position or the fully open position.

5. The bottle cap of claim 4, wherein when the multi-position valve is in the folded down position, a flexible tube portion of the multi-position valve is collapsed and prevents fluid flow through the multi-position valve.

6. The bottle cap of claim 5, wherein when the multi-position valve is in the folded down position, the flexible tube portion of the multi-position valve is collapsed due to compression between a first surface on the multi-position valve and a second surface on the body of the cap.

7. The bottle cap of claim 1, wherein the multi-position valve comprises a rigid valve base having a fluid passage therethrough, a rigid annular collar adjustably mounted around an outer surface of the valve base, a flexible sheath mounted on the collar, and a rigid stem mounted to the valve base, wherein the collar and the sheath are axially adjustable relative to the valve base and the stem to adjust the bottle cap between the selectively open position and the fully open position.

8. The bottle cap of claim 7, wherein when the bottle cap is in the selectively open position, a head of the stem seals against an inner surface of the sheath to block fluid flow from the fluid passage of the valve base through the sheath when the sheath is not engaged by the user, and an opening is formed between the head of the stem and the inner surface of the sheath when the sheath is squeezed by the user.

9. The bottle cap of claim 8, wherein the stem includes a narrow neck portion between the head of the stem and the valve base, and the opening is formed between the head of the stem and the inner surface of the sheath when the sheath is squeezed by the user around the neck portion of the stem.

10. The bottle cap of claim 7, wherein the valve base defines a fluid flow axis extending through the fluid passage of the valve base, and wherein the valve base includes a helical groove in an outer surface of the valve base and the collar includes an inwardly projecting guide pin that is engaged in the helical groove in the valve base, and the engagement between the guide pin and the groove causes the collar and the sheath to move axially relative to the valve base when the sheath and collar are rotated circumferentially relative to the valve base, such that the relative axial motion adjusts the bottle cap between the selectively open position and the fully open position.

11. The bottle cap of claim 10, wherein when the bottle cap is in the fully open position, a head of the stem is positioned within a portion of the sheath having an inner diameter that is greater than a diameter of the head of the stem, such that fluid is allowed to flow freely through the sheath around the head of the stem.

12. The bottle cap of claim 1, further comprising a slider that is slidable relative to the body between a first position wherein the slider pinches a flexible tube of the multi-position valve to prevent fluid flow therethrough and a second position wherein the slider does not pinch the flexible tube to allow fluid flow therethrough, and wherein a position of the lid relative to the body controls motion of the slider between the first and second positions.

13. The bottle cap of claim 12, wherein the lid is pivotable relative to the body about a pivot axis between a closed lid position and an open lid position, and wherein a pivotal position of the lid corresponds to a sliding position of the slider, such that the closed lid position of the lid corresponds to the first position of the slider and the open lid position of the lid corresponds to the second position of the slider.

14. The bottle cap of claim 13, wherein the lid includes a rounded surface that extends circumferentially around the pivot axis, and the rounded surface varies in radial distance from the pivot axis as a function of a circumferential position about the pivot axis, and wherein the slider includes a contact surface that engages with the rounded surface of the lid such that the position of the slider relative to the body is controlled by the radial distance from the pivot axis of the portion of the rounded surface that is in contact with the contact surface of the slider.

15. The bottle cap of claim 4, wherein the multi-position valve projects upwardly and forwardly from the body when the bottle cap is in the selectively open position and the fully open position, and the multi-position valve folds rearwardly relative to the body when the bottle cap is in the closed position.

16. The bottle cap of claim 4, wherein the multi-position valve projects upwardly and forwardly from the body when the bottle cap is in the selectively open and fully open positions, and the multi-position valve folds forwardly relative to the body in the closed position.

17. The bottle cap of claim 1, wherein the multi-position valve remains in a fixed orientation relative to the rigid body as the bottle cap is adjusted between the closed position and the selectively open position.

* * * * *